United States Patent [19]

Lang et al.

[11] 4,296,285

[45] Oct. 20, 1981

[54] HIGH-VOLTAGE, BLAST-ACTUATED POWER SWITCH HAVING FIELD ELECTRODES

[75] Inventors: Ernst Lang, Würenlingen; Lutz Niemeyer, Baden, both of Switzerland

[73] Assignee: BBC Brown, Boveri & Company Limited, Baden, Switzerland

[21] Appl. No.: 110,793

[22] Filed: Jan. 9, 1980

[30] Foreign Application Priority Data

Jan. 11, 1979 [CH] Switzerland ..... 243/79

[51] Int. Cl.[3] ..... H01H 39/00

[52] U.S. Cl. ..... 200/61.08; 337/290

[58] Field of Search ..... 200/61.08; 337/30, 290

[56] References Cited

U.S. PATENT DOCUMENTS 2,892,062 6/1959 Bruckner et al. ..... 337/290
3,848,100 11/1974 Kozorezov et al. ..... 200/61.08
4,174,471 11/1979 Ford et al. ..... 200/61.08

FOREIGN PATENT DOCUMENTS 1097016 1/1961 Fed. Rep. of Germany ..... 337/290

*Primary Examiner*—James R. Scott
*Attorney, Agent, or Firm*—Burns, Doane, Swecker & Mathis

[57] ABSTRACT

A high-voltage, blast-actuated power switch is disclosed in which field electrodes are included in order to prevent arcing within the switch after a bridge conductor has been blasted. The field electrodes are arranged coaxially about the bridge conductor, and are each electrically connected to one of two external connections. The field electrodes include opposing ends which are rounded and which are separated from each other by a distance which is smaller than the distance between the separated ends of the bridge conductor that are bent back onto internal elements of the external connections when the bridge conductor is blasted. The field electrodes tend to reduce the influence of the sharp edges formed on the separated ends of the bridge conductor when the bridge conductor is blasted, thereby increasing the breakdown voltage between the external connections and increasing the dielectric strength of the switch. An alternate embodiment of the present invention includes a floating electrode which is arranged between the opposing ends of the field electrodes.

8 Claims, 2 Drawing Figures

HIGH-VOLTAGE, BLAST-ACTUATED POWER SWITCH HAVING FIELD ELECTRODES

BACKGROUND OF THE INVENTION

In power transmission and distribution systems, rapid current rises can occur, such as those occurring during those short-circuit conditions. In order to protect the high-voltage power lines against the dynamic and thermal stresses which accompany the rapid current rises, the line must be electrically opened or cut-off before the short-circuit current has reached its peak value if the line is carrying alternating current, or before the line has reached its final value if the line is carrying direct current. The cut-off time required, which depends upon the frequency of the alternating current and on the inductance, capacitance and resistance of the power line, should not exceed a few milliseconds. Such rapid cut-off times, however, cannot be obtained with mechanically or magnetically actuated switches in medium-voltage and high-voltage power networks. Therefore, switches have been developed which are actuated by blasting.

One conventional type of blast-actuated switch contains a hollow bridge conductor which electrically connects two external connections. A blasting cap is included in the hollow region of the conductor, approximately half way between each of the external connections. The blasting cap includes two wires which may be connected to an electric ignition device. The blasting cap is ignited, thereby blasting the bridge conductor with an explosive force. To prevent the scattering of fragements of the material which make up the bridge conductor at the time of blasting, the bridge is slotted in the longitudinal direction. Conductor webs, which are defined by the slots, each include a notch or a soldered joint at their longitudinal centers. Blasting the notches or soldered joints results in the webs being bent back to form rosettes around the associated external connection.

The energy stored within the inductance of the high-voltage power line will cause a steep rise in voltage across the external connections when the bridge conductor is blasted. The voltage may rise to multiples of the operating voltage of the line. In order to prevent the rise in voltage across the separated ends of the bridge conductor from arcing and thereby delaying the cut-off process, a fusible wire is connected in parallel with the bridge conductor. The fusible wire is embedded in quenching sand. Current will flow through this wire in parallel with the separated ends of the bridge conductor and therefore arcing across the separated ends will be surpressed. As soon as the rising voltage exceeds a predetermined value, the current flow through the fusible wire causes the wire to immediately melt, and the quenching sand prevents any further arcing.

The gap between the separated ends of the bridge conductor possesses only a limited dielectric strength because the webs, bent back to form rosettes around the associated external connections, often have sharp edges. The density of the lines of flux and the gradient of the electric field potential in the vicinity of the sharp edges will be high. As a result, arcing may occur between the separated ends of the bridge conductor.

It is therefore an object of the present invention to provide a high-voltage power switch in which the electric field between the two external connections is shielded from the effects of sharp edges formed on the separated ends of the bridge conductor when the bridge conductor is blasted.

SUMMARY OF THE INVENTION

According to a preferred embodiment of the present invention, the high-voltage power switch has a casing including two electrically conductive external connections insulated from each other. The external connections are electrically connected by a bridge conductor inside the casing. The bridge conductor has an axial bore which accommodates a blasting cap. The walls of the bridge conductor in the vicinity of the axial bore include longitudinal slots. When the bridge conductor is blasted, the conductor webs which are defined by the slots are bent back to form rosettes around the associated external connections. Each external connections is electrically connected to a field electrode included within the switch. The field electrodes include rounded surfaces which oppose each other. The minimum distance between the opposing rounded surfaces of the field electrodes is smaller than the distance between the separated ends of the blasted bridge conductor.

In a switch according to the present invention, the electric field between the two external connections in the switch casing is distributed between the field electrodes. The opposing rounded surfaces of the field electrodes cause the density of the lines of flux and the gradient of the electric field potential in the vicinity of the opposing surfaces to be low. The field electrodes shape the electric field distribution such that the field distribution between the field electrodes is shielded from the effects of sharp edges included on the separated ends of the blasted bridge conductor. Consequently, the separated ends of the blasted bridge conductor are situated in relatively constant potential regions, and thus the gradient of the electric field potential at the sharp edges will be low. Therefore, in spite of the smaller distance between the opposing field electrodes than between the separated ends of the blasted bridge conductor, the dielectric strength of the gap electrically separating the two external connections in the switch casing is increased.

According to a preferred embodiment of the present invention, a third field electrode is included within the switch casing. The third field electrode is included in the gap separating the first two field electrodes. The third field electrode is allowed to electrically float, and therefore assumes a random potential. Consequently, the third field electrode causes the electric field to be more uniformly distributed, thereby increasing the dielectric strength still further.

BRIEF DESCRIPTION OF THE DRAWINGS

The preferred embodiments of the present invention are described with reference to the accompanying drawings wherein like elements bear like reference numerals, and wherein.

DESCRIPTION OF THE PREFERRED EMBODIMENTS

Figure 1:
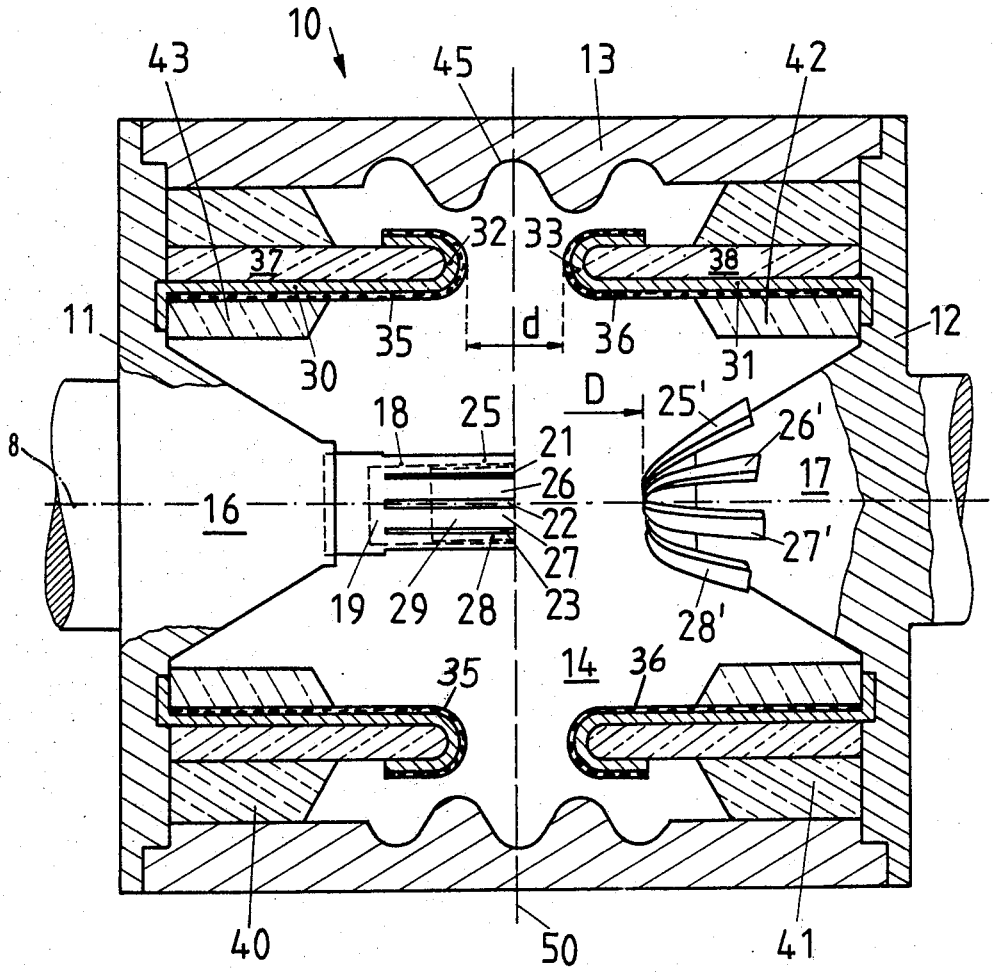
FIG. 1 is a cross-sectional view of a high-voltage, blast-actuated power switch according to the present invention, the left half of which depicts the switch before the bridge conductor is blasted and the right half of which depicts the switch after the bridge conductor is blasted.

Referring to FIG. 1, a high-voltage, blast-actuated power switch 10 includes two external connections 11, 12 which are mechanically connected to each other by a tube 13 made from an insulating material. The tube 13 is sealed to each of the external connections 11, 12 so as to form a gas-tight and fluid-tight switch casing 14.

The switch 10 is rotationally symmetric about an axis 8. The external connections 11, 12 have truncated conical sections 16, 17, respectively which project into the switch casing 14 and oppose each other. A bridge conductor 18 is included between the opposing conical sections 16, 17, and electrically connects the external connections 11, 12.

The bridge conductor includes an axial bore 19 and slots 21, 22, 23 which extend in the axial direction and which delineate conductor webs 25, 26, 27, 28. The conductor webs each include a predetermined breaking point (not illustrated) at their longitudinal centers. A blasting cap 29 is accommodated in the axial bore 19 of the bridge conductor. Electric ignition wires of the blasting cap (not illustrated) extend to the outside of the switch.

Cylindrical field electrodes 30, 31 are included in the switch casing 14 and are coaxially disposed about the truncated cones 16, 17 and the axis 8. The field electrode 30 is electrically connected to the external connection 11, and the field electrode 31 is electrically connected to the external connection 12. The inside radius of each field electrode 30, 31 is preferably greater than one-half the length of the bridge conductor so that when the bridge conductor is blasted and the conductor webs 25, 26, 27, 28 are bent back, the conductor webs do not come into physical contact with the field electrodes.

The field electrodes 30, 31 each include a rounded surface or rim 32, 33 which is formed over a tubular support 37, 38, respectively. The rims 32, 33 each have a semi-circular cross-section.

The tubular supports 37, 38 increase the mechanical strength of the field electrodes 30, 31. Additionally, outer tubular rings 40, 41 and the inner tubular rings 43, 42 further increase the mechanical strength of the field electrodes 30, 31, respectively. The supports 37, 38 and the rings 40, 41, 42, 43 are each made of an insulative material, preferably a plastic.

The inner wall of the tube 13 includes a wavy groove 45 which increases the electrical breakdown path in the switch casing 14 between the external connections 11, 12. And, the entire surface of each fluid electrode 30, 31 projecting into the switch casing 14 is covered with an insulative layer 35, 36, respectively.

When the blasting cap 29 is exploded, the explosive force tears apart the bridge conductor at the predetermined breaking points of the conductor webs 25, 26, 27, 28. The conductor webs are bent back to form rosettes around the associated truncated conical secions 16, 17 of the external connections 11, 12. The right side of FIG. 1 illustrates the conductor web sections 25', 26', 27', 28' bent back to form a rosette around the associated truncated conical section 17 of the external connection 12.

After the bridge conductor is blasted and the external connections 11, 12 electrically disconnected from each other, a potential difference exists between those elements of the switch electrically connected to the external connection 11 and those elements of the switch electrically connected to the external connection 12. The potential difference gives rise to an electric field which is most powerful between those elements which are physically nearest to each other and which are connected to the external connections. Consequently, the electric field is most powerful between the opposing rounded surfaces or rims 32, 33 of the field electrodes 30, 31, respectively. However, since the rims 32, 33 are circularly rounded, the electric field in the vicinity of the rim is relatively homogenous and therefore the breakdown potential of the gap separating the field electrodes is relatively high.

The conductor webs which are bent back around the associated conical sections of the external electrodes may contain sharp edges. However, the field electrodes shape the potential distribution such that the sharp edges of the conductor webs are located in relatively constant potential regions of the electric field distribution. Thus the field electrodes tend to shield the bent back conductor webs 25', 26', 27', 28' so that the gradient of the electric field potential about the sharp edges is small in magnitude.

One embodiment of a switch according to the present invention, designed for a voltage rating of 20 kV and tested under field conditions, included field electrodes 30, 31 separated one from the other by a minimum distance d of 1 cm. The rims 32, 33 of the field electrodes each had a radius of 0.5 cm. The distance between the top surfaces of the two conical sections 16, 17 was 6 cm so that after the bridge conductor 18 was blasted the distance D between the bent back conductor web sections was approximately 4 cm greater than the distance d between the field electrodes.

Figure 2:
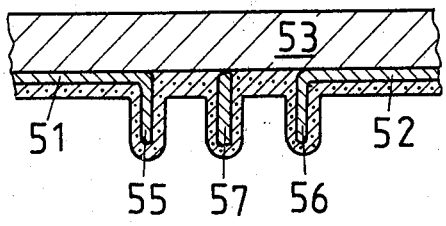
FIG. 2 is a cross-sectional view illustrating an alternate arrangement of the field electrodes in a switch according to the present invention.

Referring to FIG. 2, another embodiment of a high-voltage, blast-actuated power switch according to the present invention includes two field electrodes 51, 52 which are in close proximity to an electrically insulative tube 53 which separates two external connections (not illustrated). The field electrodes 51, 52 include ends 55, 56 which are bent toward the longitudinal axis of the switch so as to form annular discs. A field electrode 57 is included in the gap between the field electrodes 51, 52. The electrode 57 is an annular disc which is electrically insulated from both of the field electrodes 51, 52. Consequently, the electrode 57 assumes a potential somewhere between the potentials of the field electrodes 51, 52.

The electrode 57 tends to divide the breakdown path between the field electrodes 51, 52 into two regions, causing the electric field to be more homogenous in the gap betweeen the field electrodes 51, 52 and increasing the breakdown strength of the gap. The dielectric strength of the gap is increased beyond that of the embodiment illustrated in FIG. 1. The electrodes are filled with, and surrouned by synthetic resin so that their mechanical strength is improved and their breakdown voltage increased still further.

According to a preferred embodiment of the present invention, it is preferably to include an excess pressure valve (not illustrated) in the switch casing or in one of the external connections to enable the pressure generated by the explosion of the blasting cap to be vented in a specific direction. Such a valve prevents damage to the switch casing and to adjacent facilities when the bridge conductor is blasted by the blasting cap. In switches according to the present invention in which the switch casing is filled with a high pressure gas, for example $SF_6$ in order to increase the breakdown voltage, it is most preferable to include such an excess pressure valve.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Moreover, variations and changes may be made by those skilled in the art without departing from the spirit of the present invention.

What is claimed is:

1. A high voltage, blast-actuated power switch having a hollow switch casing and having first and second external electrical connections, said first and second external connections being electrically insulated from each other, said switch comprising:

bridge conductor means included within said switch casing for electrically connecting said first external connection to said second external connection, said bridge conductor means having first and second bridge conductor elements electrically connected to said first and second external connections, respectively, and said first and second bridge conductor elements being separatably connected to each other;

means for physically separating said first bridge conductor element from said second bridge conductor element by a first distance so as to electrically disconnect said first external connection from said second external connection; and first and second field electrodes included within said switch casing, said first and second field electrodes being electrically connected to said first and second external connections, respectively, and said first and second field electrodes being separated by a second distance;

wherein said second distance is less than said first distance.

2. A high-voltage, blast-actuated power switch having a hollow switch casing and having first and second external electrical connections, said first and second external connections being electrically insulated from each other, said switch comprising:

a bridge conductor included within said switch casing, said bridge conductor electrically connecting said first external connection to said second external connection, and said bridge conductor having an axial bore;

blasting means accommodated within said axial bore for blasting said bridge conductor so as to electrically disconnect said first external connection from said second external connection such that said bridge conductor is separated into a first bridge conductor element electrically connected to said first external connection and a second bridge conductor element electrically connected to said second external connection, said first and second bridge conductor elements being electrically disconnected from each other and said first and second bridge conductor elements being separated from each other at least by a first distance;

a first field electrode included within said switch casing, said first electrode being electrically connected to said first external connection; and a second field electrode included within said switch casing, said second field electrode being electrically connected to said second external connection;

wherein said first and second field electrodes are separated from each other at least by a second distance; and wherein said second distance is less than said first distance.

3. A high-voltage, blast-actuated power switch having a hollow switch casing and having first and second external electrical connections, said first and second external connections being electrically insulated from each other, said switch comprising;

a bridge conductor included within said switch casing, said bridge conductor electrically connecting said first external connection to said second external connection, and said bridge conductor having an axial bore and having a region which includes a plurality of longitudinal slots, said region being disposed in the vicinity of said axial bore;

blasting means for blasting said bridge conductor so as to electrically disconnect said first external connection from said second external connection, said blasting means being accommodated in said axial bore;

a first field electrode included within said switch casing, said first field electrode having a first rounded surface, and said first field electrode being electrically connected to said first external connection; and a second field electrode included within said switch casing, said second field electrode having a second rounded surface, and said second field electrode being electrically connected to said second external electrode;

wherein said first and second rounded surfaces are opposed to each other, and wherein said first and second rounded surfaces are separated from each other at least by a first distance;

wherein when said bridge conductor is blasted by said blasting means said region having said longitudinal slots is bent back toward said external connections so as to form a first region electrically connected to said first external connection and a second region electrically connected to said second external connection, and wherein said first and second regions are separated from each other at least by a second distance; and wherein said first distance separating said first and second rounded surfaces is less than said second distance separating said first and second regions.

4. The switch according to claim 3 wherein said first and second field electrodes are each disposed coaxial to said bridge conductor, and wherein said opposing first and second rounded surfaces are each substantially equidistance from the longitudinal center of said bridge conductor.

5. The switch according to claim 3 further comprising:

a third field electrode included within said switch casing, said third field electrode being disposed between said opposing first and second rounded surfaces of first and second field electrodes, and said third field electrode being allowed to electrically float.

6. The switch according to claim 3 wherein said first and second field electrodes are at least partially covered with an electrically insulative layer.

7. The switch according to claim 3 wherein said first and second rounded surfaces included on said first and second field electrodes, respectively, each have a semicircular cross-section having a radius at least equal to one-half said first distance.

8. The switch according to claim 3 wherein said first distance is less than one-half said second distance.

* * * * *